US005281175A

United States Patent [19]

Chupak et al.

[11] Patent Number: 5,281,175

[45] Date of Patent: Jan. 25, 1994

[54] FEMALE ELECTRICAL TERMINAL

[75] Inventors: John M. Chupak, West Middlesex, Pa.; Edward M. Bungo, Cortland, Ohio; Paul G. Halbach, Wuppertal, Fed. Rep. of Germany; Ludwig Pauss, Essen-Kettwig, Fed. Rep. of Germany; Michael Model, Breckerfeld, Fed. Rep. of Germany

[73] Assignee: General Motors Corporation, Detroit, Mich.

[21] Appl. No.: 40,310

[22] Filed: Mar. 30, 1993

[51] Int. Cl.[5] ..... H01R 13/00

[52] U.S. Cl. ..... 439/839; 439/852

[58] Field of Search ..... 439/839, 842, 843, 845, 439/849, 851–853, 858, 861, 862

[56] References Cited

U.S. PATENT DOCUMENTS

| | | | |
|---|---|---|---|
| 3,310,772 | 3/1967 | Kirk et al. | 339/217 |
| 3,555,496 | 1/1971 | Pearce, Jr. et al. | 339/217 |
| 3,836,947 | 9/1974 | Yeagher | 439/852 |
| 4,540,235 | 9/1985 | Lolic | 439/839 |
| 4,586,775 | 5/1986 | Nestor et al. | 339/97 R |
| 4,781,628 | 11/1988 | Detter et al. | 439/748 |
| 4,834,681 | 3/1989 | Chaillot | 439/852 |

*Primary Examiner*—Joseph H. McGlynn
*Attorney, Agent, or Firm*—William A. Schuetz

[57] ABSTRACT

The present invention relates to an electrical female, box shaped terminal with a resilient contact arm which can receive different thicknesses of mating male terminals. The female terminal provides a controlled normally directed contact force against the male terminal.

10 Claims, 5 Drawing Sheets

FEMALE ELECTRICAL TERMINAL

The present invention relates to an electrical connector and, more particularly, to an electrical, female, box shaped terminal having a resilient contact arm and which is of a design such that it can be connected to different thickness mating male blade terminals and which provides for a controlled normally directed contact force against the male terminal.

Heretofore, female, box shaped electrical terminals have been provided. These terminals included either a single or double resilient contact arms for engaging a male mating blade terminal when the latter was inserted therein. U.S. Pat. Nos. 4,586,775 and 3,310,772, assigned to the General Motors Corporation, an assignee of the present invention, shows such terminals respectively. Patent No. 4,586,775 also shows a cantilevered support arm 48 for engaging the end of a resilient contact arm or tongue 44 to increase the contact force on the tab or male blade terminal when the latter is inserted between the tongue 44 and a dimple 46 on the floor of the female terminal.

While the prior box shaped female terminals have been highly successful in use, they nevertheless are primarily designed for receipt of male blade terminals of a standard nominal thickness dimension. However, in different countries in the world, the standard thickness of male blade terminals varies and thus different size female terminals must be designed to accommodate each thickness. Also, it is highly desirable to have a low insertion force when connecting a male blade terminal to a box shaped, female terminal while also having a relatively high contact force between the terminals to provide a connection therebetween which ensures good electrical conductivity. This is especially so when a plurality of male terminals contained in a multi-cavity insulated electrical connector body are simultaneously mated to a plurality of box shaped, female terminals contained in a multi-cavity insulated electrical connector body. While some trade-off between the insertion force and the mating contact force has to be made in designing electrical terminals, it has been found that if the contact force between the male terminal and the female terminal is normal to the direction of insertion of the male blade terminal that a relatively high contact force can be obtained without creating a high insertion force.

Accordingly, it is an object of the present invention to provide a new and improved box shaped, female electrical terminal having a deflectable contact arm and which is constructed and arranged such that it can be used with mating male blade terminals of varying thicknesses whereby a single female terminal can be designed for global use.

Another object of the present invention is to provide a new and improved female, box shaped electrical terminal in which a mating male blade terminal can be mated thereto with a relatively low insertion force and yet have a relatively high normally directed blade contact force to provide for good electrical conductivity therebetween.

The objects and advantages of the present invention are achieved by providing a female electrical terminal which comprises a one piece, stamped metal member which has a forward, generally box shaped main body portion and a rearward conductor engaging portion. The main body portion comprises a generally planar bottom, a pair of spaced sides, a first upper member defining a resilient contact arm integral with one of the sides and extending transversely thereof toward the other side and a second upper member defining a resilient back up spring integral with the other of the sides and extending transversely of the sides and overlying the contact arm. The contact arm has a forward end section extending downward toward, but spaced from, the bottom to define a gap. The contact arm exerts a resisting force when deflected by a mating male terminal upon the latter being slidably inserted between the bottom and the forward end section of the terminal. The terminal also includes a substantially rigid tab extending transversely of the other side and which is engageable with the contact arm along its underside to control the spacing of the gap between the contact arm and the bottom of the terminal. The backup spring is engageable with the contact arm and provides a further resilient resisting spring force in addition to the spring force exerted by the forward section of the contact arm when it is mated to a mating male blade terminal.

The advantages of the above terminal are that it is capable of receiving mating male blade terminals of varying thicknesses. By controlling the dimension of the gap between the contact arm and the bottom of the terminal, the terminal provides a sufficient engaging force with even a minimum male thickness blade terminal so that good electrical conductivity is obtained between the male blade terminal and the female terminal. Another advantage is that the contact between the resilient contact arm and the male blade terminal is such that it provides a resisting force directed against the male blade terminal, when being inserted into the female terminal, which is normal or perpendicular to the plane of the male blade terminal. This not only provides a sufficient contact force for good electrical conductivity, but also provides for a relatively low insertion force since the resisting force is directed normal to the direction of the insertion force.

The present invention further resides in various novel constructions and arrangement of parts, and further objects, novel characteristics and advantages of the present invention will be apparent to those skilled in the art to which it relates and from the following detailed description of the illustrated, preferred embodiments thereof made with reference to the accompanying drawings forming a part of this specification and in which similar reference numerals are employed to designate corresponding parts throughout the several views, and in which.

Figure 1:
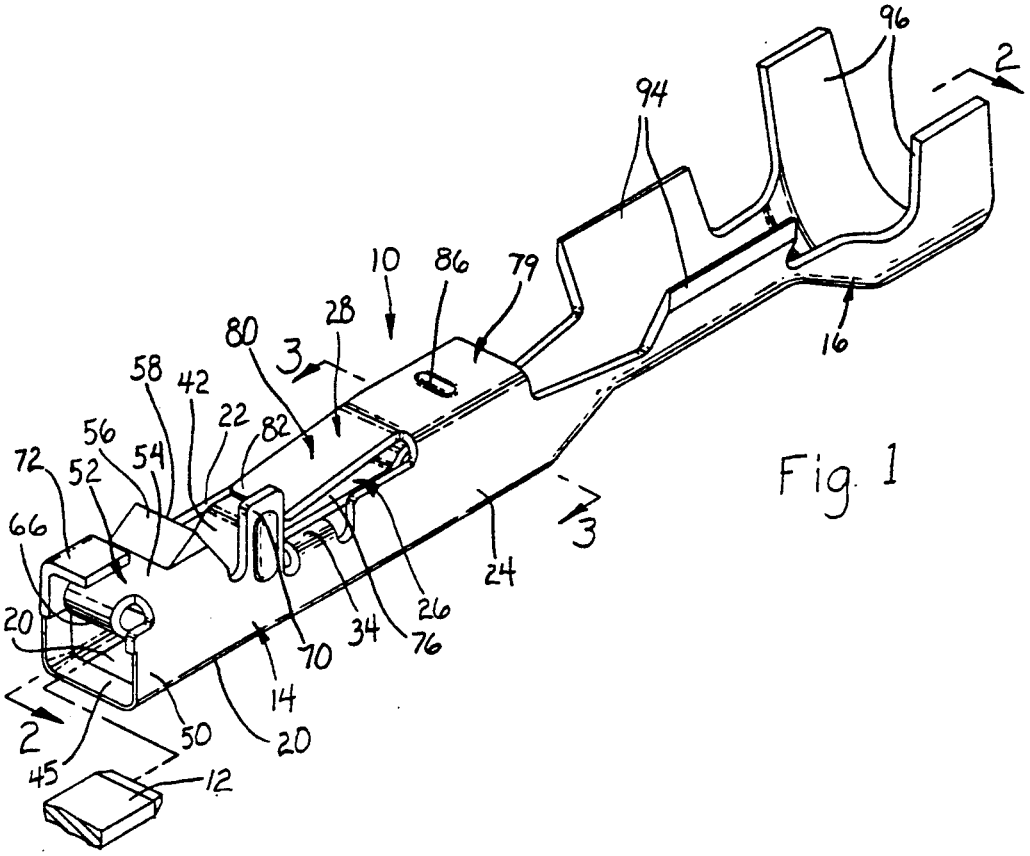
FIG. 1 is a perspective view of a female, box shaped terminal of the present invention.

FIGS. 1-8 disclose a first embodiment of a novel female box shaped terminal 10 of the present invention which is adapted to be mated with a male blade terminal 12.

The electrical terminal 10 is a one piece metal member of relatively thin gauge metal stock and comprises, in general, a forward, generally box shaped main body portion 14 and a rearward conductor engaging portion 16. The main body portion 14 comprises a generally planar bottom 20, a pair of spaced sides 22, 24 extending transversely to the bottom 20, a first upper member defining a resilient or deflectable contact arm 26 integral with the side 22 adjacent its upper end and extending transversely thereof toward the other side 24, and a second upper member defining a resilient or deflectable backup spring 28 integral with the side 24 adjacent its upper end and extending transversely thereof toward the other side 22 and overlying the contact arm 26. The contact arm 26 has a forward end section 30 which extends downward toward and is spaced from the bottom 20 to define a gap 32. The gap 32 has a transverse dimension or width W which is controlled by a substantially rigid tab 34 integral with the side 24 and which engages the contact arm 26 along its underside. The forward section 30 of the contact arm 26 exerts a normally or perpendicularly directed resisting force when deflected by the mating blade terminal 12 upon the latter being slidably inserted between the bottom 20 and the forward end section 30 of the terminal 10. The backup spring 28 is engageable with the contact arm 26 and provides a further resisting spring force directed normally of the male blade terminal 12 in addition to the spring force exerted by the forward section 30 of the contact arm 26 when being mated to the mating male terminal 12.

The generally planar bottom 20 of the forward portion 14 of the electrical terminal 10 includes a raised dimple or portion 40 which is located directly beneath the forward end section 30 of the resilient contact arm 26. The raised area 40 strengthens the bottom or floor 20 of the terminal and provides a flat surface for slidably receiving and mating with the male blade terminal 12.

The forward section 30 of the resilient contact arm 26 includes a leg or leg portion 42 which extends downwardly toward the raised contact area 40 and an upwardly extending leg or leg portion 44 extending toward the forward end 45 of the terminal 10. The legs 42, 44 are integrally connected via a bight 46 having a curved or rounded undersurface 48 located directly above the raised area 40 on the bottom 20. This curved surface 48 provides a line or narrow width contact with the male blade terminal 12 extending transversely of the terminal 10 when the male blade 12 is inserted between the raised portion 40 and the bight 46 of the forward end section 30 of the resilient contact blade 26.

Figure 2:
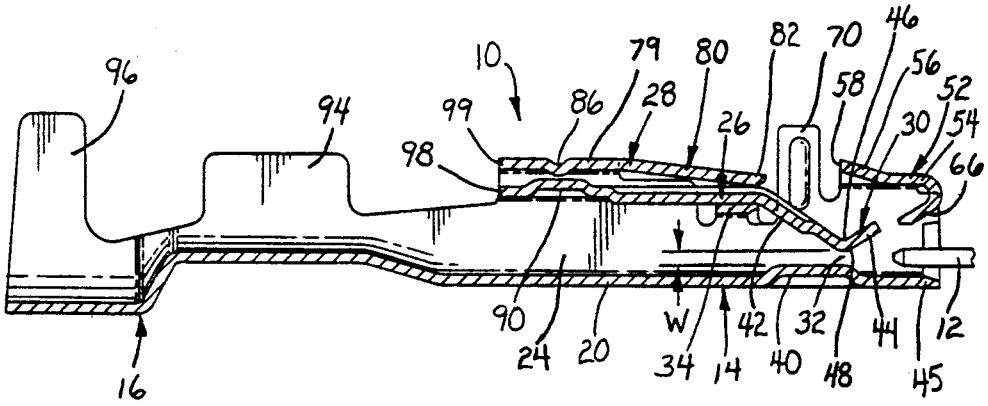
FIG. 2 is a longitudinal cross sectional view taken approximately along the lines 2—2 of FIG. 1.
Figure 3:
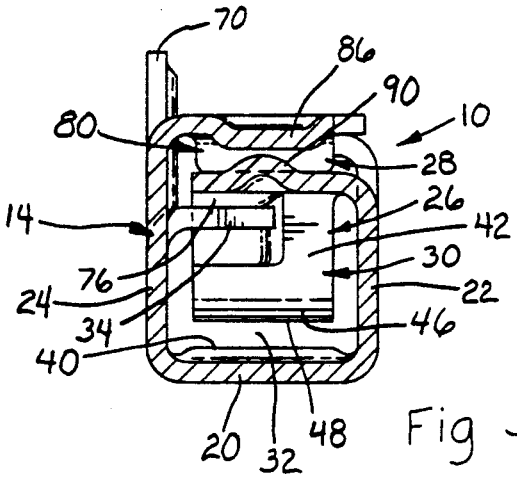
FIG. 3 is a cross sectional view taken along the lines 3—3 of FIG. 1.
Figure 4:
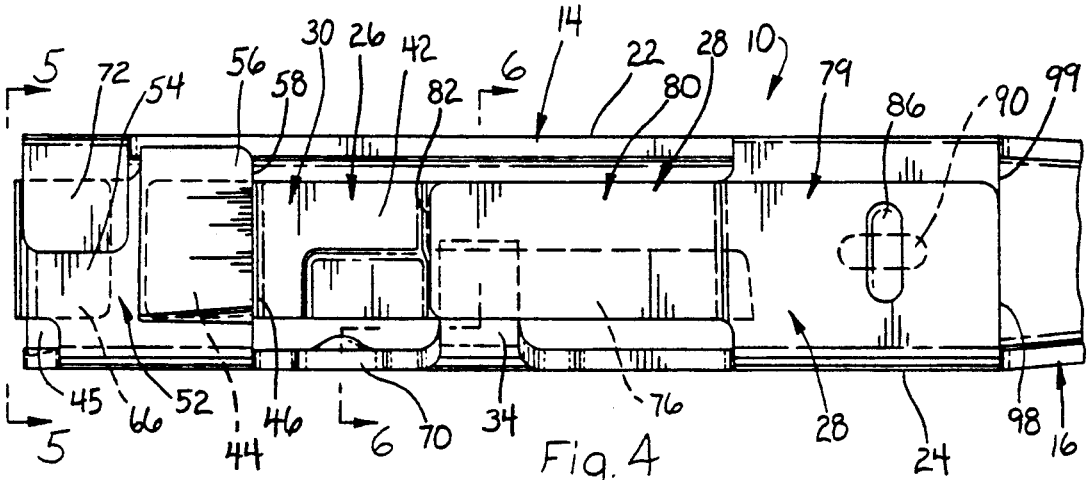
FIG. 4 is a top plan view of the electrical terminal shown in FIG. 1.
Figure 5:
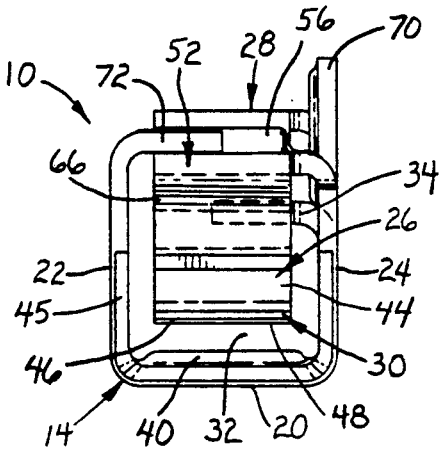
FIG. 5 is an end elevational view looking in the direction of the arrow 5—5 of FIG. 4.
Figure 8:
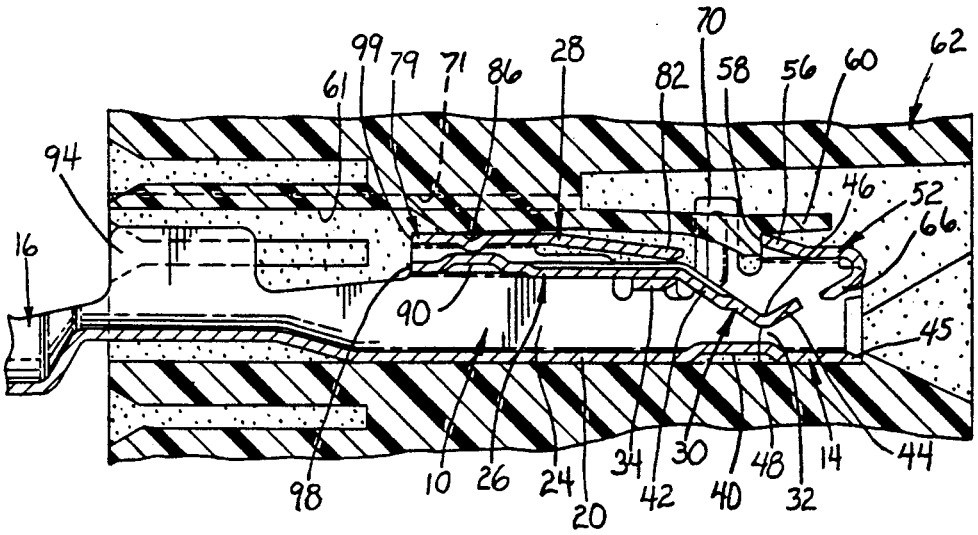
FIG. 8 is a fragmentary cross sectional view of the connector insulator body and showing the terminal of FIG. 1 connected thereto.
Figure 9:
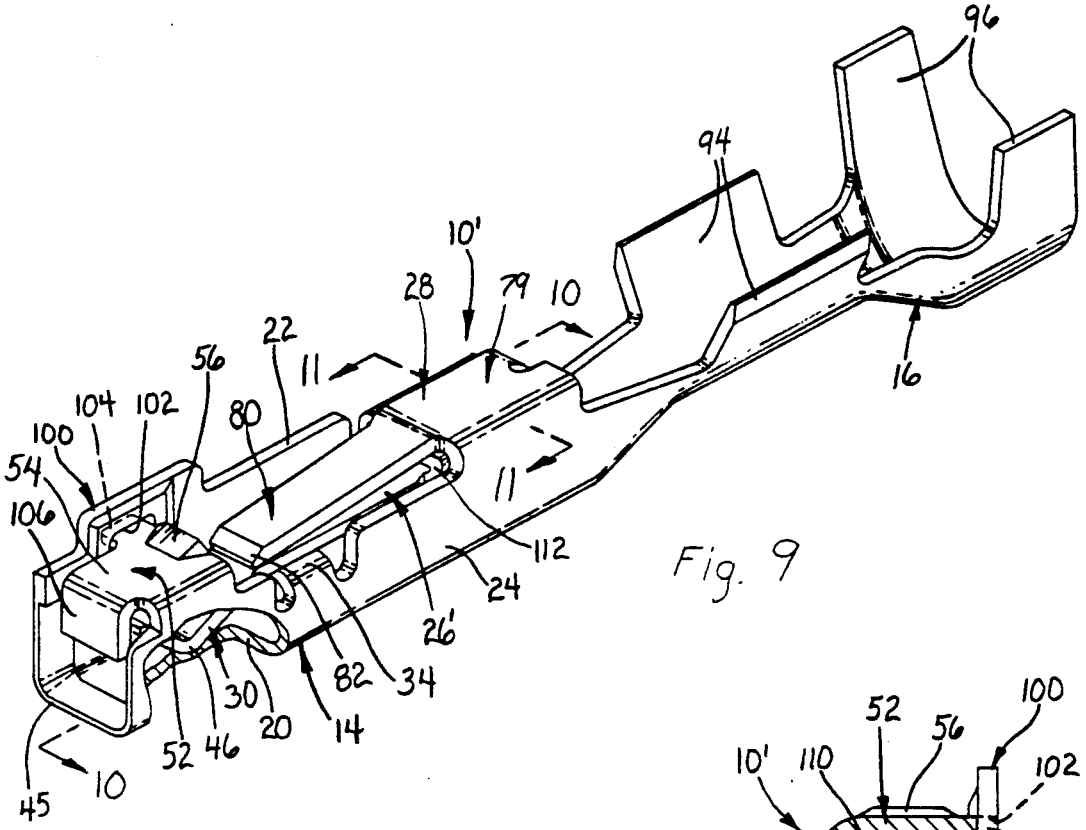
FIG. 9 is a perspective view of a second embodiment of a female electrical terminal of the present invention.
Figure 11:
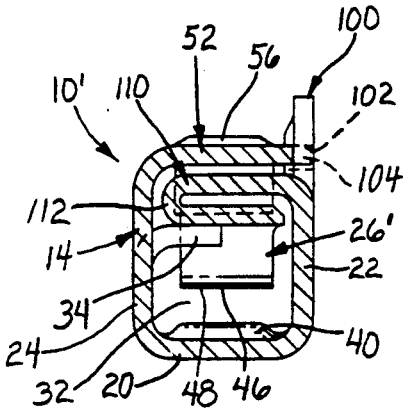
FIG. 11 is a cross sectional view taken approximately along line 11—11 of FIG. 9.
Figure 10:
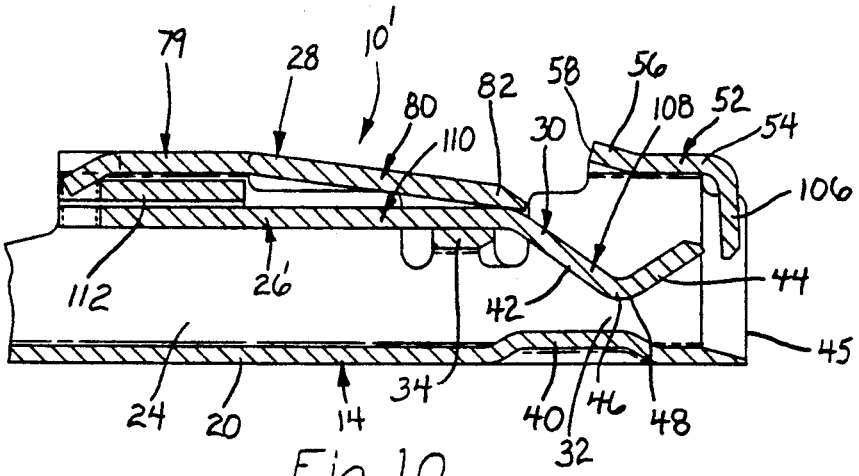
FIG. 10 is a fragmentary longitudinal cross sectional view taken approximately along line 10—10 of FIG. 9.
Figure 12:
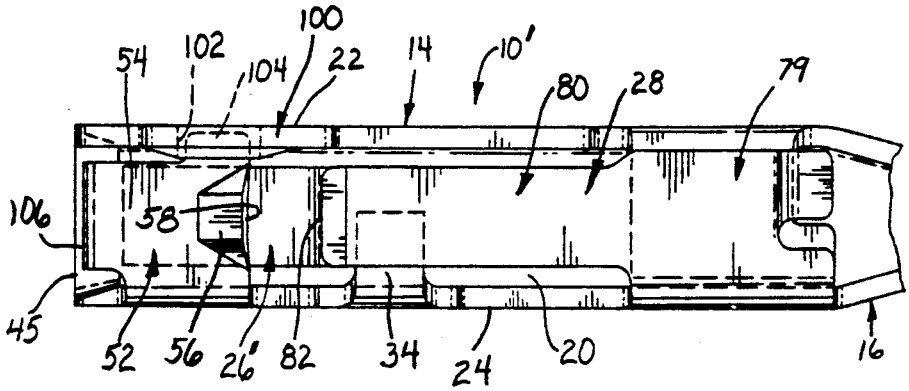
FIG. 12 is a fragmentary top plan view of the electrical connector shown in FIG. 9.

The sides 22, 24 extend transversely, preferably normal, to the bottom 20 and are parallel to each other. The sides 22, 24 are respectively integrally connected to the resilient contact blade 26 and the resilient backup spring 28 along their rearward sections, as viewed in FIG. 1. The side 24 at its forward section 50, as shown in FIG. 1, is integral with a top 52 which extends normal or transversely thereof at its upper end. Top 52 has a flat portion 54 adjacent its forward end and a raised or upstruck portion 56 at its rearward end. As best shown in FIG. 8, the upstruck portion or tang 56 defines a lock shoulder 58 facing rearwardly of the terminal and is adapted to engage a deflectable lock finger 60 in a cavity 61 of a connector body 62, as shown in FIG. 8, when the terminal 10 is connected to the connector body 62, and in a conventional manner well known to those skilled in the art. The top 52 also includes a reversely bent portion 66 which extends downwardly and rearwardly toward the leg 44 of the forward end section 30 of the resilient contact arm 26, as best shown in FIG. 2. The rearwardly and downwardly directed portion 66 provides a guide for entry of the male blade terminal 12 into the female terminal 10. The top 52 covers the contact area between the male terminal 12 and forward end section 30 and the bottom 20 and thus aids in preventing contamination of the contact area. The top 52 also protects the forward end section 30 of the contact arm 26 from being accidentally deflected or moved so as to change the width W of the gap 32.

The side 24 also includes a vertically extending tang or tab 70. The tab 70 is a guide tab which is slidably received in a slit or slot 71 in the cavity 61 of the mating connector body 62 and provides for properly orienting the female terminal 10 in the connector body 62.

The side 22 at its forward end includes a tab 72 which is bent transversely of the side 22 and over the top 52. This maintains the square box shape of the forward end 45 of the terminal 10 and rigidifies the forward end of the terminal 10.

Figure 6:
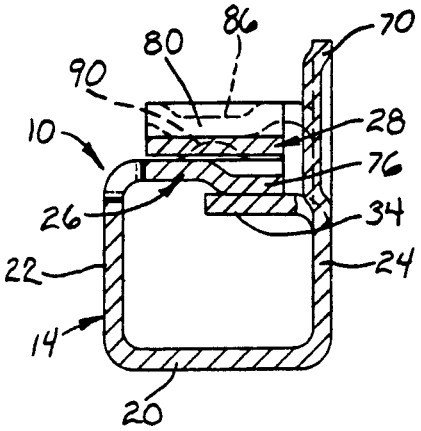
FIG. 6 is a cross sectional view taken approximately along line 6—6 of FIG. 4.

The positioning tab 34 is substantially rigid and is integral with the side 24 at its upper end. The tab 34 extends normal to the side 24 and engages the underside of the resilient contact arm 26 along its longitudinal free side portion 76 remote from the side 22, as shown in FIG. 6. The contact arm 26 is bent to be step shaped in cross section so that free side portion 76 is flat to engage the flat contact tab 34. The tab 34 accurately controls the vertical dimension or width W of the gap 32 between the bight 46 and the raised portion 40 of the bottom 20.

The backup spring 28 has a rearward section 79 which is parallel with the contact arm 26 and a forward section 80 which extends downwardly at an angle toward the top side of the resilient contact arm 26 so that its forward end 82 engages the contact arm 26. The backup spring 28 includes a dimple 86 in its rearward section 79 which is spaced from but adapted to engage a raised portion 90 on the contact arm 26.

From the foregoing, it should be apparent that the electrical connector 10 can be mated with its mating male blade terminal 12 by inserting the male blade terminal 12 into the gap 32 between the bottom 20 and the bight 46 of the forward end section 30 of the resilient contact blade 26. When the male blade 12 is inserted therebetween, the forward end section 30 is caused to be deflected upwardly, which in turn, due to its engagement with the forward section 80, causes the backup spring 28 to be deflected upwardly. The force exerted on the male blade terminal 12 will be normal to the direction of insertion of the male blade terminal 12 and will be exerted at the interface between at the bight 46 and the raised portion 40 on the male blade terminal.

The positioning of the tab 34 can be such as to provide for a minimum gap 32 or width W to accommodate a male blade terminal 12 having a minimum thickness. If male blade terminals 12 of larger thicknesses are inserted, the terminal 10 can accommodate them as a result of the resiliency of the contact arm 26 and backup spring 28. Since the forces resisting insertion of the male blade terminal 12 are directed normally of the male blade terminal, the insertion force required for mating the two terminals 10 and 12 is minimized. It should be noted that if a larger thickness male blade terminal 12 is mated to the female terminal 10, and the forward end section 30 and backup spring 28 are deflected a predetermined extent, the dimple 86 will engage the raised portion 90 on the contact arm 26. This will increase the stiffness of the contact arm 26 and backup spring 28 and thus, provide further resistance.

Additionally, it should be noted that the gap 32 can be readily adjusted by controlling the position of the cross tab 34 relative to the bottom 20. Thus, one gap dimension W could be employed for mating with a given thickness male blade terminal 12 and if a much larger thickness male blade terminal 12 were contemplated to be used, the stamping die for forming the terminal 10 could be slightly modified to reposition the tab 34 vertically relative to the bottom 20, as viewed in FIG. 2, to cause width W of the gap 32 to be altered.

Figure 7:
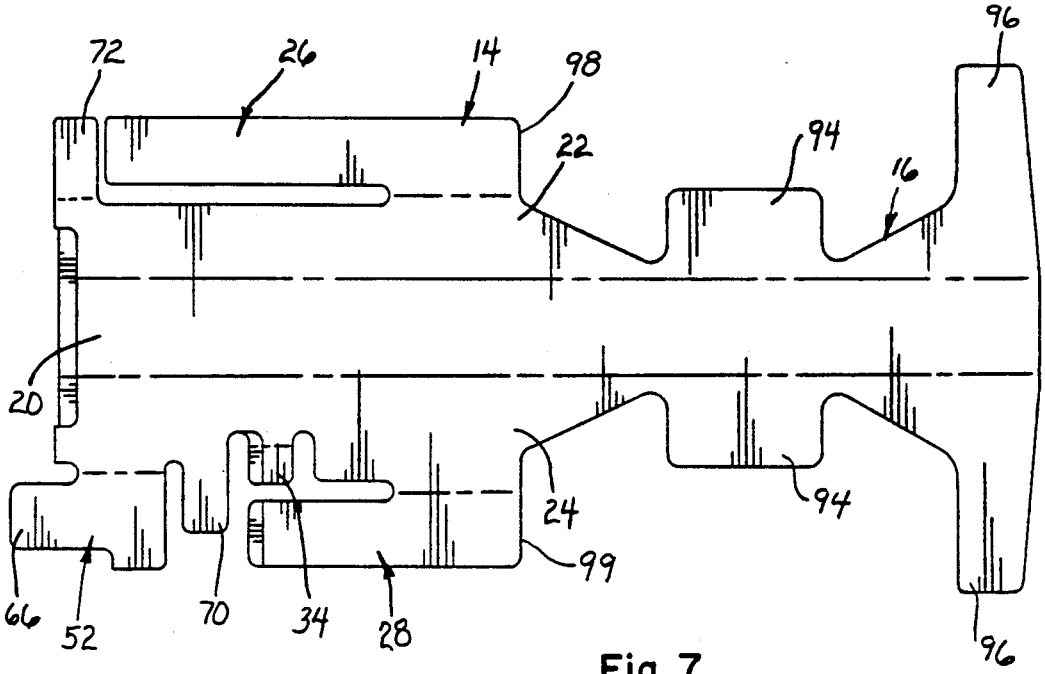
FIG. 7 is a top plan view of the electrical terminal of the present invention and showing the same in blank form prior to being folded to the configuration shown in FIG. 1.

As shown in FIG. 7, the electrical terminal 10 is made in one piece from flat metal stock, such as brass, and is initially stamped to the configuration shown in FIG. 7. Note that the stamping for the main portion 14 of the terminal 10, as viewed in FIG. 7, is generally rectangular in shape and thus of a shape which provides for minimum offal. The terminal 10 is stamped to the configuration shown in FIG. 1 by first stamping in the raised portions 40, raised portion 90 and end section 30 and the dimple 86, in the bottom 20, contact arm 26 and backup spring 28, respectively. Then the terminal 10 is then formed by bending up the sides 22, 24, then bending over the tab 34 90 degrees and then bending the resilient contact arm 26 to lie over and into engagement with the tab 34, and then bending the resilient backup spring to lie over top of the resilient contact arm 26. At the same time, the portion 66 at the forward end of the blank is reversely bent and then the top 52 is bent to lie over the bottom 20 and thereafter the tab 72 is bent over the top 52 to complete the formation of the terminal 10.

The rearward portion 16 of the terminal includes spaced crimping wings 94, 96 which are adapted to be crimped onto a bare wire portion and an insulated portion of a wire conductor (not shown), and in a manner well known to those skilled in the art.

The contact arm 26 and the backup spring 28 at their rearward ends 98 and 99, respectively, are vertically aligned, as shown in FIG. 2. These ends 98, 99 could be used as further lock shoulders to receive a terminal portion assurance member (not shown) which could be inserted transversely of the connector body 62 through a transverse opening (not shown), if desired.

FIGS. 9-13 show an alternate embodiment of a novel electrical terminal 10' of the present invention. The electrical terminal 10' is identical to the terminal 10 and hence, the same reference numerals will be employed to designate corresponding parts throughout the views. The terminal 10' differs from the previously described terminal 10 in that the tab 72 of the terminal 10 has been eliminated and in its stead the side 22 has a raised portion 100 provided with a window or opening 102. This window 102 receives a transverse tab 104 integral with the top 52 and with the tab 104 being received through the window 102 to control the square box shape at the forward end 45 of the terminal 10'. Also the terminal 10' has a forward end 106 integral with the top 52 which is merely bent downwardly toward the bottom 20 instead of being reversely curled inward like portion 66 of the terminal 10.

Figure 13:
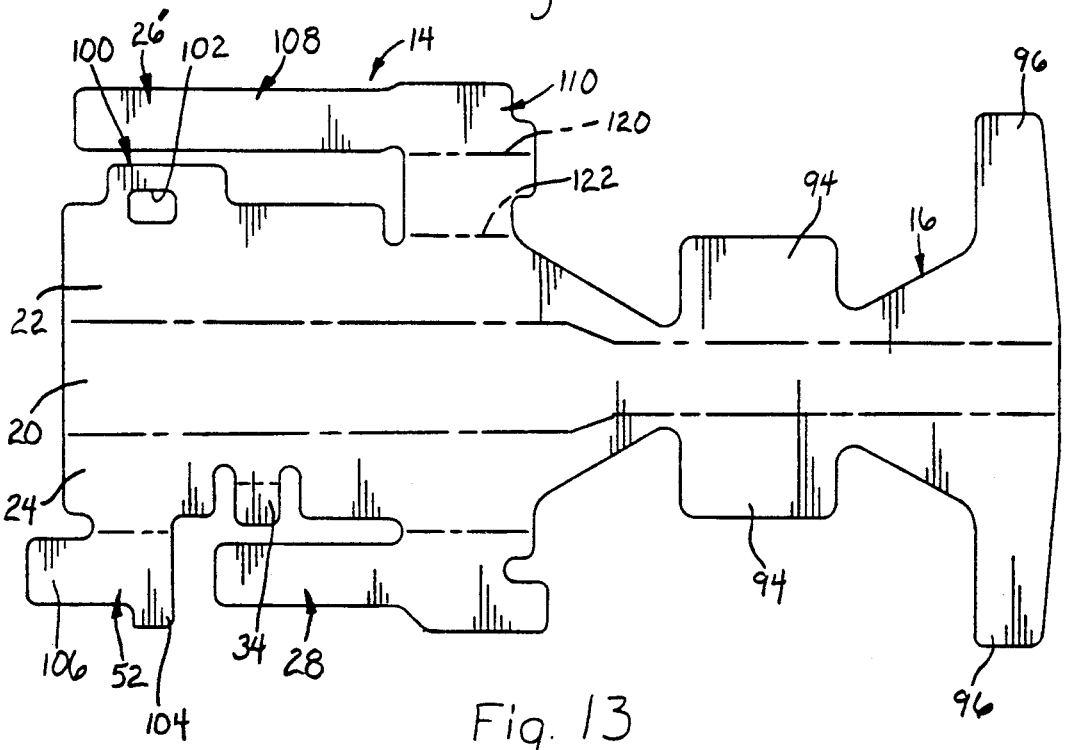
FIG. 13 is a top plan view of the electrical connector of the present invention and showing the same in blank form prior to being folded.

Another difference is that it has a somewhat different contact arm 26'. The resilient contact arm 26' has a forward section 108 and rearward section 110 which is reversely bent onto itself or to be juxtaposed, as indicated by reference numeral 112 in FIG. 11, prior to being bent to lie over the tab 34 bottom. The rearward section 110 is double the width of the remainder of the contact arm 26 so that it can be folded onto itself. This increases the strength of the resilient contact arm 26' at its rearward portion which engages the backup spring 28. The double folded rearward section 110 replaces the dimples 86, 90 in the terminal 10. As shown in FIG. 13, the forward section 108 and half the rearward section 110 of the resilient contact arm 26' is first bent over and folded along line 120 over and onto the other half of the rearward section 110. The contact arm 26' is then folded along line 122 so as to be normal to the side 22 and with the forward section 108 engaging the tab 34. In all other respects, the electrical terminal 10' of this embodiment is the same, operates in the same manner and functions to achieve the same results as the terminal 10 previously described.

Although the illustrated embodiments hereof have been described in great detail, it should be apparent that certain modifications, changes and adaptations may be made in the illustrated embodiments, and that it is intended to cover all such modifications, changes and adaptations which come within the spirit of the present invention.

The embodiments of the invention in which an exclusive property or privilege is claimed are defined as follows:

1. An electrical terminal which is adapted to be connected to an electrical conductor comprising:

a one-piece metal member which has a forward generally box shaped main body portion and a rearward conductor engaging portion, the box shaped main body portion comprising a generally planar bottom, a pair of spaced sides extending transversely of said bottom, a first upper member defining a deflectable contact arm integral with one of the sides adjacent its upper end and extending transversely thereof toward the other side, and a second upper member defining a deflectable back up spring integral with the other of the sides adjacent its upper end and extending transversely thereof toward the one side and overlying said contact arm, said contact arm having a forward end section extending downward toward, but spaced from, said bottom to define a gap, said contact arm exerting a resisting force when deflected by a mating male terminal upon the latter being slidably inserted between said bottom and said forward end section of said terminal, a substantially rigid tab extending transversely of said other side and being engageable with said contact arm along its underside to control the spacing of said gap between the contact arm and said bottom, said back up spring being engageable with said contact arm and providing a further resisting spring force in addition to the spring force exerted by the forward section of the contact arm when mated to a mating male terminal.

2. An electrical terminal which is adapted to be connected to a wire conductor comprising:

a one-piece metal member of relatively thin gauge metal stock and which has a forward generally box shaped main body portion and a rearward crimping wing portion which is adapted to be crimped to an electrical connector, the main body portion comprising a generally planar bottom, a pair of spaced sides extending transversely of said bottom, a first upper member defining a deflectable contact arm integral with one of the sides at its upper end and extending transversely thereof toward the other side, and a second upper member defining a deflectable back up spring integral with the other of the sides at its upper end and extending transversely thereof toward the one side and overlying and engaging said contact arm, said deflectable contact arm having a forward end section extending downward toward, but spaced from, said bottom to define a gap and which is adapted to slideably engage a mating male blade terminal when the latter is inserted between said bottom and said forward end section, said contact arm deflecting and exerting a force generally normal to the male blade terminal when the latter is connected between said bottom and said forward end section, a substantially rigid tab extending transversely of said other side and being engageable with said contact arm along its underside to control the spacing of said gap between the forward end section of the contact arm and said bottom, said deflectable back up spring exerting a further generally normal resisting spring force in addition to the spring force exerted by the forward section of the contact arm when mated to a mating male terminal.

3. An electrical terminal which is adapted to be connected to a wire conductor comprising:

a one-piece metal member of relatively thin gauge metal stock and which has a forward generally box shaped main body portion and a rearward crimping wing portion which is adapted to be crimped to an electrical connector, the main body portion comprising a generally planar bottom, a pair of spaced sides extending transversely of said bottom, a first upper member defining a deflectable contact arm integral with one of the sides at its upper end and extending transversely thereof toward the other side, and a second upper member defining a deflectable back up spring integral with the other of the sides at its upper end and extending transversely thereof toward the one side and overlying and engaging said contact arm, said deflectable contact arm having a forward end section including a first leg extending downward toward said bottom, a second leg extending upwardly toward a forward end of the terminal and a bight between said legs, said bight having a rounded undersurface which is spaced from said bottom to define a gap and with the bight adapted to slideably engage a mating male blade terminal when the latter is inserted between said bottom and said forward end section, said contact arm deflecting and exerting a force generally normal to the male blade terminal when the latter is connected between said bottom and said forward end section, a substantially rigid tab extending transversely of said other side and being engageable with said contact arm along its underside to control the spacing of said gap between the bight of said forward end section of the contact arm and said bottom, said deflectable back up spring exerting a further generally normal resisting spring force in addition to the spring force exerted by the forward section of the contact arm when mated to a mating male terminal.

4. An electrical terminal, as defined in claim 3, and wherein said contact arm and said backup spring adjacent their rearward end have aligned raised portions which are engageable with each other.

5. An electrical terminal, as defined in claim 3, and wherein said contact arm has rearward end sections which are folded to be juxtaposed to one another so as to increase the rigidity of the rearward end of the contact arm, said rearward end section being engageable with said backup spring when the contact arm is deflected.

6. An electrical terminal, as defined in claim 3, and wherein said bottom has a flat raised portion located beneath said bight of said forward end section of said contact arm which is adapted to engage one side of a mating blade terminal when the latter is inserted between the bight and said raised portion.

7. An electrical terminal, as defined in claim 3, and wherein said terminal includes a top at its forward end which is integral with one of the sides and which overlies said bight and second leg of said forward section of said contact arm.

8. An electrical terminal, as defined in claim 7, and wherein said top is upstruck at its rearward end to define a lock shoulder which is adapted to engage a deflectable lock finger on a plastic connector body.

9. An electrical terminal, as defined in claim 7, and wherein said terminal at its forward end also has a tab integral with the other of its sides which is bent over the top to further rigidify the forward end of the terminal.

10. An electrical terminal, as defined in claim 7, and wherein said top has a projecting tab which extends through an opening in the other side of the terminal to rigidify the forward end of the terminal.

* * * * *